US005562267A

United States Patent [19]

Heim et al.

[11] Patent Number: 5,562,267

[45] Date of Patent: Oct. 8, 1996

[54] CROSS-TIES FOR RAILROAD TRACK SYSTEMS

[75] Inventors: Armin Heim, Kreuzlingen, Switzerland; K. Ohm, Schwabach, Germany; K Spiegel, Hassfurt, Germany; Rudolf Köpl, Munich, Germany; Jurgen Kruger, Wunstorf, Germany; Volker Klein, Hamburg, Germany; Hans-Joachim Scholte, Iserlohn, Germany

[73] Assignee: Schwihag GmbH, Tagerwilen, Switzerland

[21] Appl. No.: 237,365

[22] Filed: May 5, 1994

[30] Foreign Application Priority Data

May 7, 1993 [DE] Germany ..... 43 15 200.7

[51] Int. Cl.[6] ..... E01B 7/00

[52] U.S. Cl. ..... 246/415 R; 246/449; 246/453; 238/29

[58] Field of Search ..... 246/415 R, 442, 246/443, 448–453; 238/29, 30, 45, 56, 62, 63, 70

[56] References Cited

U.S. PATENT DOCUMENTS 1,069,484 8/1913 Smith ..... 238/62
1,345,580 7/1920 Burton ..... 246/448
1,358,536 11/1920 Fisk ..... 238/62
1,802,875 4/1931 Conley ..... 246/415 R

*Primary Examiner*—S. Joseph Morano
*Attorney, Agent, or Firm*—Watson Cole Stevens Davis P.L.L.C.

[57] ABSTRACT

A box sleeper (1), characterized by a steel box-like sleeper section member (5) which has a cross-sectional width (15) and a cross-sectional height (16) matching that of a normal concrete or wooden sleeper and has an open part (31) on top and is closable at its ends by transverse plates (17 and 18) and has laterally projecting bearing flanges (13 and 14) for stockrail fasteners (28, 29), points-tongue slide chairs (30) and/or operating components of tip fasteners. The box-like sleeper section member (5) is associated with tip fasteners in the form of "latch fasteners" (33) comprising stationary guides (32) and movable latches (34), cam rods (34) and cam-rod bearings (37), all of which project into the upper part (31) of the box-like sleeper section member (5), whereas the bottom part houses the points-tongue slide rods (54), the tongue-monitoring linkage (45), heating rods (43) if any, and shock-absorbing elements (38). The open part (31) of the box-like sleeper section member (5) is closable on top by releasably mounted covers which can be secured to the bearing flanges (13 and 14) of the box-like sleeper section member (5) of the box sleeper (1).

20 Claims, 8 Drawing Sheets

CROSS-TIES FOR RAILROAD TRACK SYSTEMS

The invention relates to a sleeper for railway track systems, suitable for incorporation in the track near points, more particularly near the drives and the associated tip fastenings for the points tongues, which are adjustable via slide rods.

Conventionally, in the construction of modern railway track systems, the sleepers are either mainly of impregnated wood with banded ends or of prestressed concrete. The sleepers are laid at intervals of 630 or 600 mm in track sections with normal traffic, or 580 mm intervals for high-speed traffic.

Near points, particularly in the region of the drives and associated tip fastenings for the points tongues, which are adjustable via slide rods, it has hitherto been necessary to form "sleeper compartments", in which the spacing between adjacent sleepers is greater than normal, i.e. usually between 680 and 700 mm. A heating plate is incorporated in the enlarged sleeper compartment and rests substantially on the gravel, i.e. inside the sleeper compartment it covers the gravel bed, which extends from beneath only as far as the bearing surface of the sleepers.

Accordingly the sleeper compartment contains all the operating components needed for driving the points, clamping the tongues, and preventing the points moving accidentally.

These sleeper compartments result in serious deficiencies, particularly in the case of points in "high-speed" sections of rail. For example, automatic tamping with fully mechanized track tamping machines is impossible near the sleeper compartments. Only one of the two sleepers belonging to a compartment can be tamped, and only by hand externally on one side. Manual tamping inside the sleeper compartment is impossible, not only because the drive and monitoring linkages for the points tongue are situated there, but also because the gravel bed there is almost completely covered by the heating plate.

Since manual tamping of the two sleepers in a compartment does not lead to optimum results, the sleepers may become unsteady after a short time and frequently have to be manually re-tamped.

Another disadvantage is that the resilience of the track system in the vertical and the horizontal direction is disturbed by the sleeper compartment, and also large accumulations of dirt occur there, because no cover is present. Consequently the sleeper compartment often has to be cleaned, to ensure that the points operate reliably.

In view of these shortcomings, the aim of the invention is to design a sleeper according to the preamble so as to obviate the need to construct "sleeper compartments" near points while providing space for efficient operation of a drive and the associated tip fastenings for the points tongues, which are adjustable via slide rods. A particularly important aim is that the high-tech mechanised method of track construction, i.e. use of fully automatic track-tamping machines with a levelling system and track-raising devices, should be possible in the neighborhood of the points tongues also.

According to the invention, the aim is achieved and the problem solved by an upwardly open steel trough or box-like sleeper section member which has a cross-sectional width and a cross-sectional height matching that of a normal concrete or wooden sleeper and is optionally closable or closed at its ends by transverse plates and has laterally projecting bearing flanges not only for rail securing means and for points-tongue slide chairs but also for the operating components of the tip fastenings and the trough or box-like sleeper section member is associated with tip fastenings in the form of "latch fastenings", e.g. SBB/ISAG type CKA, comprising stationary guides and movable latches and cam rods which project into the upper part of the pressure member, whereas the bottom part houses the points-tongue slide rod, the tongue-monitoring linkage, heating rods if any, and shock-absorbing elements.

Since the trough or box-like sleeper section member of the sleeper according to the invention matches conventional concrete and/or wooden sleepers, the vertical and horizontal elasticity of the track system is not affected, even near a points drive, and consequently there is no loss of comfort during high-speed travel.

Advantageously also, according to the invention, the trough or box-like sleeper section member is closable on top by a cover which is releasably attached and can e.g. be secured to the bearing flanges of the trough or box-like sleeper section member, so that the points drive is substantially free from disturbances due to dirt.

Advantageously also, a prolongation on one side of the trough or box-like sleeper section member holds the electric drive for the points-tongue slide rod. The drive also can be protected from dirt by a cover.

According to another important development or feature of the invention, an elastomeric shock-absorbing element engages each movable bearing of the latch fastening and is received in the trough or box-like sleeper section member and is braced against the bottom thereof so as to be pivotable between two end positions. The purpose of these shock-absorbing elements is to pull the slide tongue, both when adjacent and when in the remote position, towards the slidechair surfaces with a force of about 200 to 300 Kp, thus substantially absorbing vibration. The vertical shock-absorption travel is about 3 or 4 mm. Each shock-absorbing element is under compressive stress and has a strong damping effect and, above all, a long service life.

If the sleeper is used in a track system comprising conventional concrete sleepers, advantageously the part of the trough or box-like sleeper section member underneath the bearing flange is given an outer coating, e.g. of fibre concrete, more particularly of glass-fibre concrete, so that the friction between it and the gravel bed is the same as for normal concrete sleepers. The outer coating should also be provided around the prolongation of the trough or box-like sleeper section member, i.e. at least under the bottom of the trough section member. If there is no concrete outer coating around the flanges of the prolongation, the internal width of the prolongation can be made correspondingly greater, so as to leave correspondingly more room for the electric drive.

The composite sleeper member comprising the steel trough section member with two bent flanges and the outer concrete coating is specially stabilized according to the invention, in that the outer coating is provided with steel edge-protecting angle members braced against the trough or box-like sleeper section member and is also anchored thereto in a number of places by expanding bolts.

Cable ducts extending lengthwise can also be secured under the bearing flanges of the trough or box-like sleeper section member, so that cables there can be completely protected against mechanical action, and no cable ducts have to be laid subsequently through the gravel bed and tend to break it up.

According to another important feature of the invention, the bearing flanges are reinforced by metal sheets against the sides of the trough or box-like sleeper section member, so that all forces acting on the flanges can be directed into the trough or box-like sleeper section member.

Advantageously also, water outlet openings are provided in both end plates, i.e. at both ends of the trough or box-like sleeper section member, and the cover thereof is formed with recesses only in the neighbourhood of the moving parts of the latch fastening, and the recesses can be covered by plastics bellows as a protection against rain and snow.

The steel trough or box-like sleeper section member, which is closed or closable at both ends by transverse plates, together with its outer covering or concrete casing constitutes a structural member which may be defined as a "box sleeper".

An embodiment of the invention is shown in the accompanying drawings, in which:

FIG. 1, made up of FIGS. 1*a* and 2*a* which belong together, is a longitudinal section through a box sleeper underneath a stock rail and the tongue of a spring point together with the associated points drive and tip fastening components;

FIG. 2, likewise divided into FIGS. 2*a* and 2*b*, is a plan view of the box sleeper in FIG. 1, but shows only the mounted stock rail, the means securing it and the associated points tongues and slide chairs, without the tip fastening components;

Figure 1A:
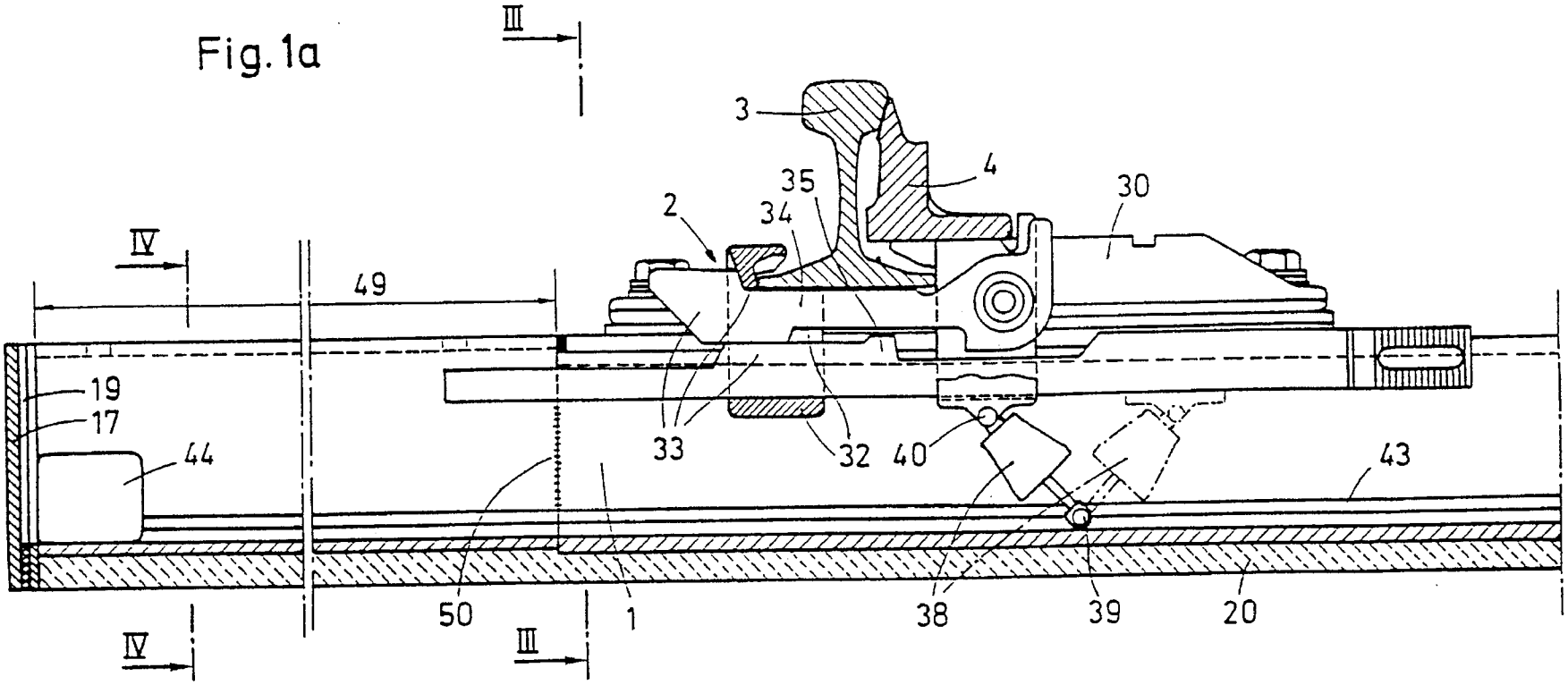

Normally in modern railway track systems, the sleepers in the track assembly comprising sleepers and rails are usually either of impregnated wood with banded ends or are prestressed concrete sleepers, which have substantially the same cross-sectional shape and dimensions. The sleepers are laid on the gravel bed of the superstructure crown, at intervals of 630 or 600 mm for normal traffic or about 600 mm in high-speed sections.

Hitherto it has been impossible to maintain the above spacing between adjacent sleepers in the region of the points, particularly where space must be found for the electric drive for the points tongues and the tip fastenings operative between the tongues and the stock rails. The operating components all have to be housed in "sleeper compartments", which need a spacing between 680 and 700 mm.

The serious disadvantages and shortcomings of these compartments, which interrupt the uniform sleeper spacing, have already been mentioned. They are eliminated by using a "box sleeper" 1, as shown in FIGS. 1 to 8 and described in detail hereinafter with reference thereto.

The box sleeper 1 is used together with tip fastenings for the points tongues 4 associated with the stock rails 3. The tip fastenings are preferably latch fastenings 2, known under the SBB/ISAG designation CKA 9.

Alternatively the box sleeper 1 could be combined with points-tongue locking devices of the kind proposed in DE 40 14 248 A1 and DE 40 14 249 A1. One special advantage of the CKA 9 latch fastening is that it needs only a relatively narrow, low holder for the latches, the adjustable fastening rod and the fastener bearing, and more particularly the overall width of the holder can be less than the maximum cross-sectional width of wooden and concrete sleepers.

The drawings show an embodiment of a box sleeper comprising a trough or box-like sleeper section member of steel, more particularly sheet steel, as shown particularly in FIGS. 3 and 7 and 4 and 8. The trough or box-like sleeper section member 5 has a bottom or web 6 from which two upward arms 7 and 8 extend and are integrally connected thereto by a respective arcuate intermediate member 9, 10 having a relatively large radius of curvature (about 40 mm). At the top, each arm 7, 8 adjoins a horizontal bearing flange 13, 14, via an arcuate intermediate member 10. 11 having a smaller radius of curvature (about 18 mm). The bottom or web 6 and the bearing flanges 13 and 14 of the trough or box-like sleeper section member 5 are aligned parallel to one another and the two arms 7 and 8 extend substantially at right-angles thereto.

As shown in FIGS. 3 and 7 and 4 and 8, the box sleeper 1 has a cross-sectional width 15 and a cross-sectional height 16 matching that of a normal concrete or wooden sleeper, i.e. is substantially matched therewith.

Figure 1B:
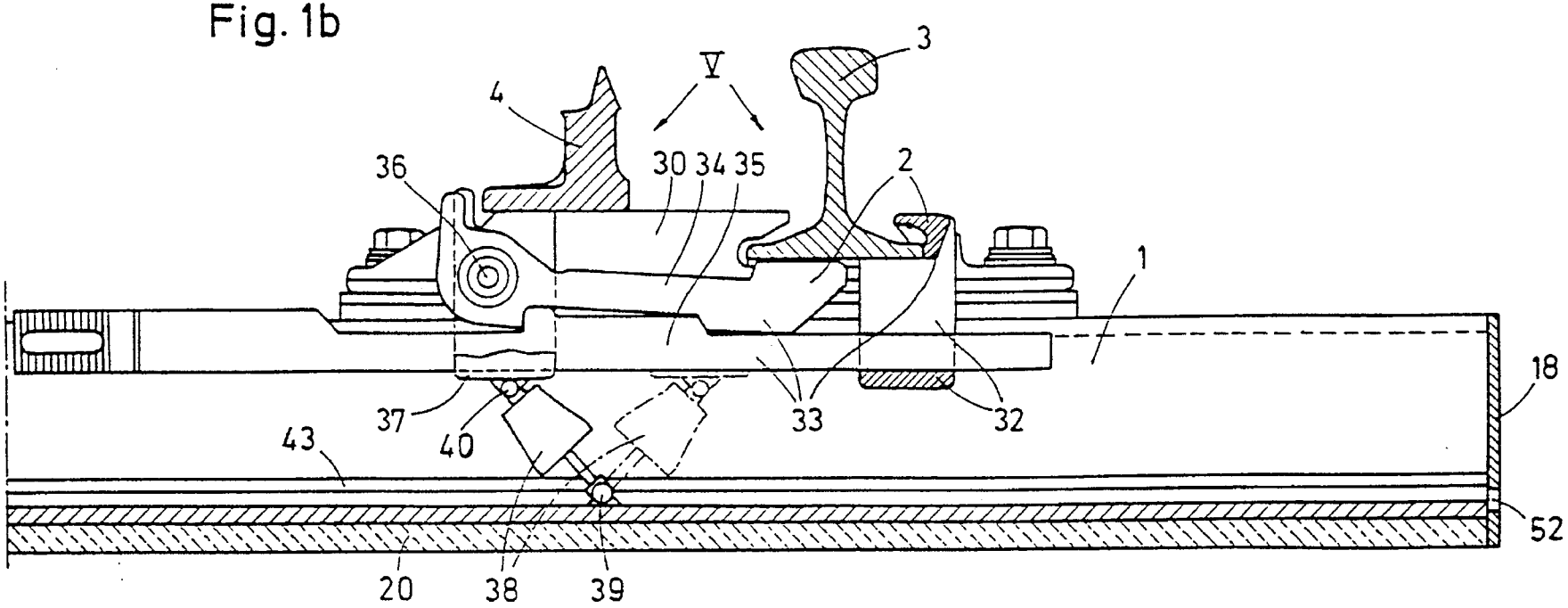
Figure 2A:
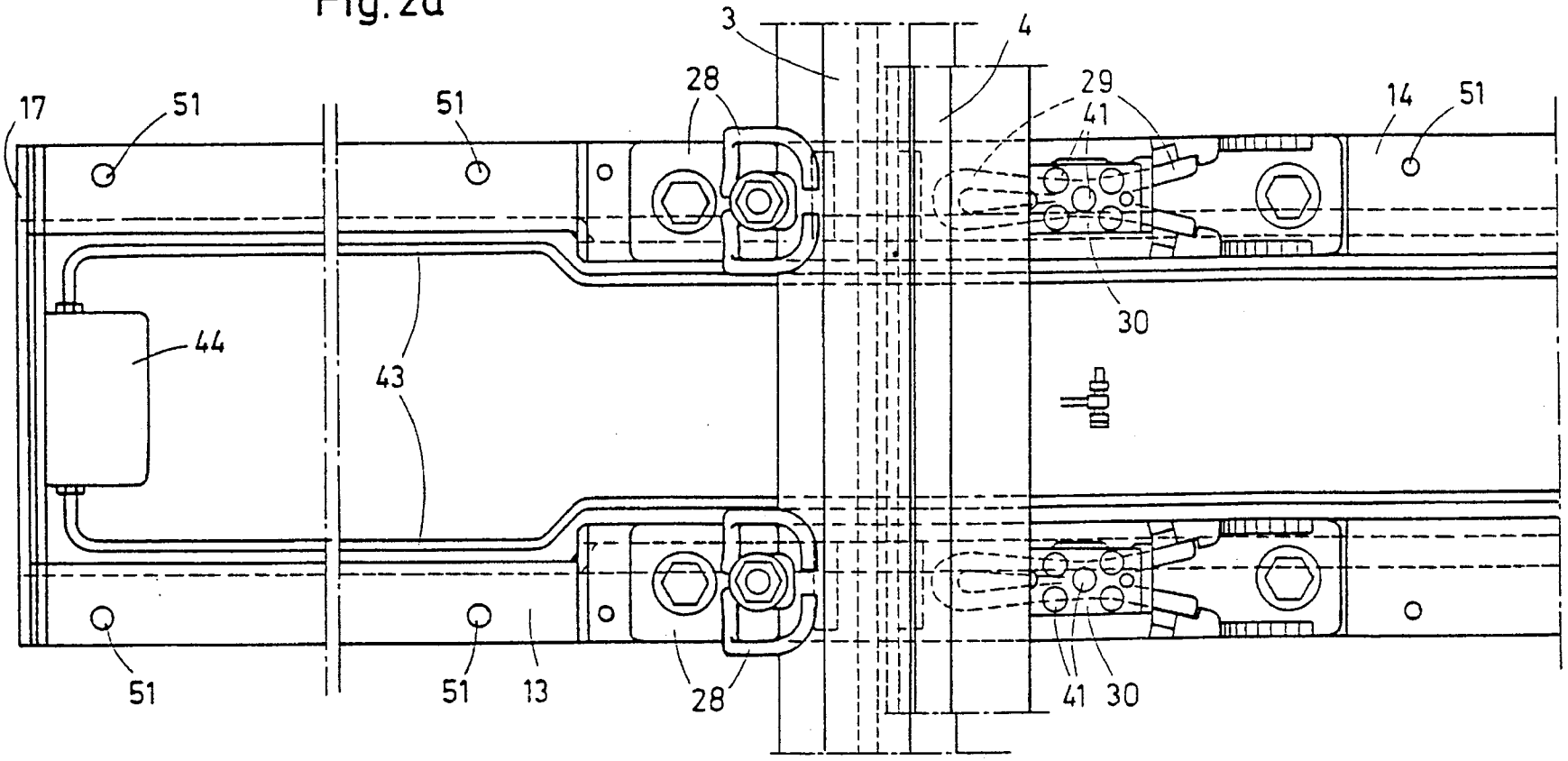
Figure 2B:
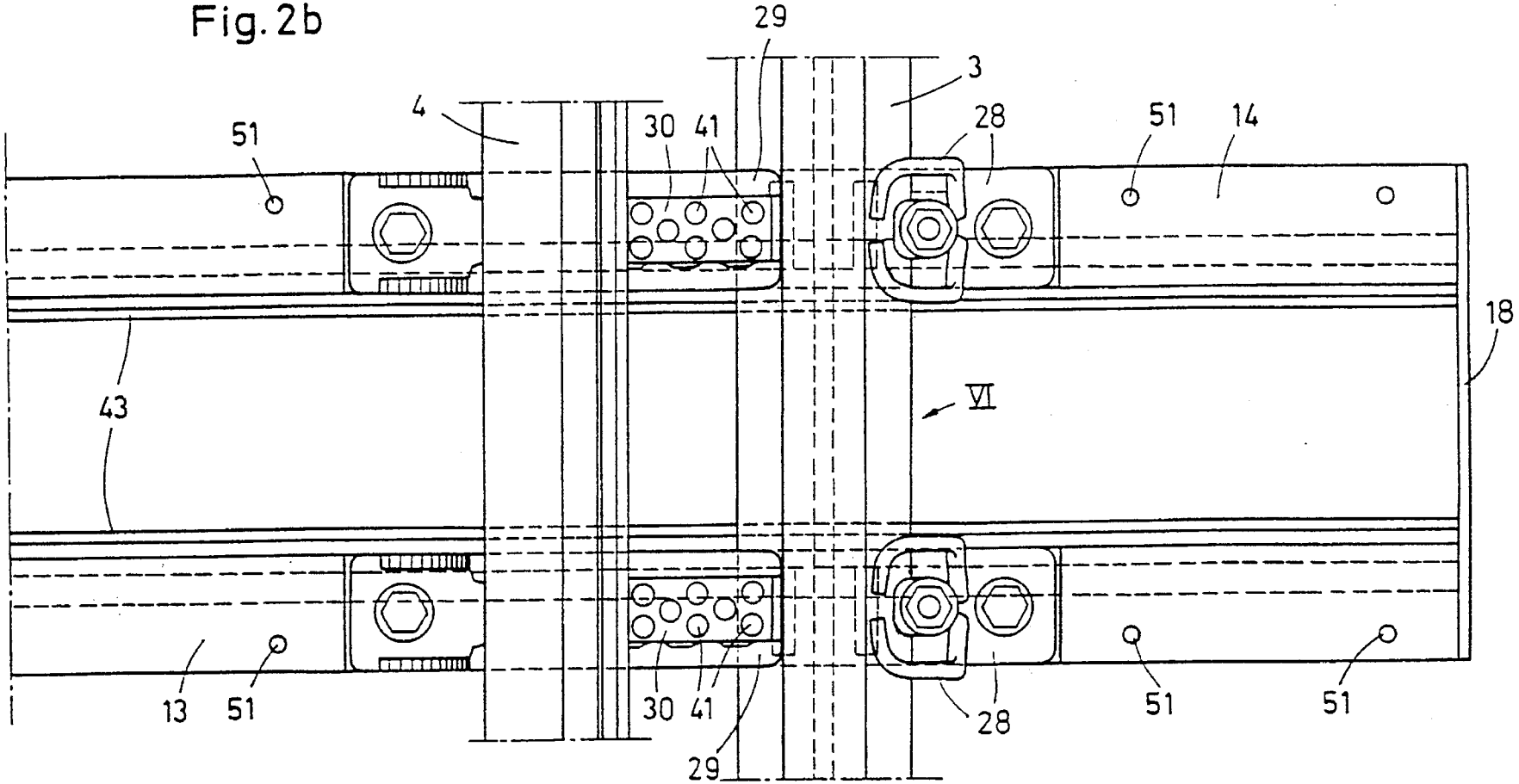

The upwardly open trough or box-like sleeper section member 5 is converted into the box sleeper 1 by closing its ends by transverse plates 17, 18 respectively. The plate 17 can be releasably screwed to the trough or box-like sleeper section member 5 with interposition of a seal 19, whereas the plate 18 is permanently connected or welded to the trough or box-like sleeper section member 5. Plate 17 is shown in FIGS. 1*a* and 2*a,* whereas plate 18 is shown in FIGS. 1*b* and 2*b*.

If a box sleeper 1 is laid together with wooden sleepers, it will consist simply of the trough or box-like sleeper section member 5 and the two transverse plates 17 and 18, in which case the trough or box-like sleeper section member 5 will have at least one corrugated outer side, so that when the box sleeper 1 interacts with the gravel bed of the superstructure, the friction will be at least approximately the same as between wooden sleepers and the gravel bed.

Figure 4:
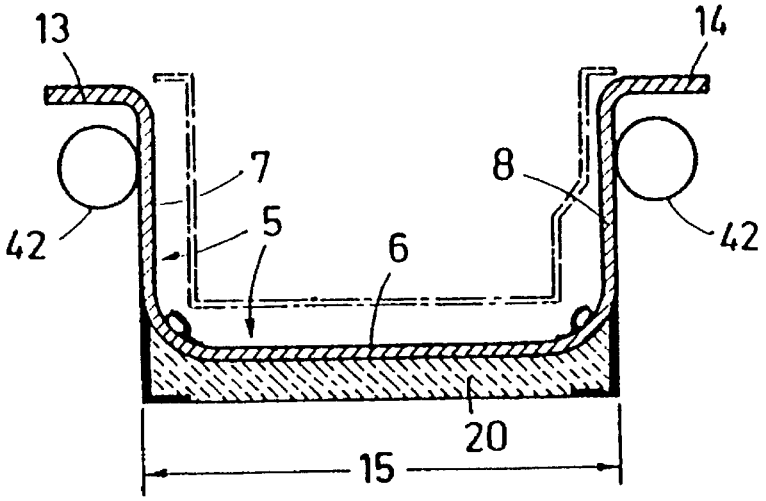
FIG. 4 is a section along line IV—IV in FIG. 1*a:*
Figure 5:
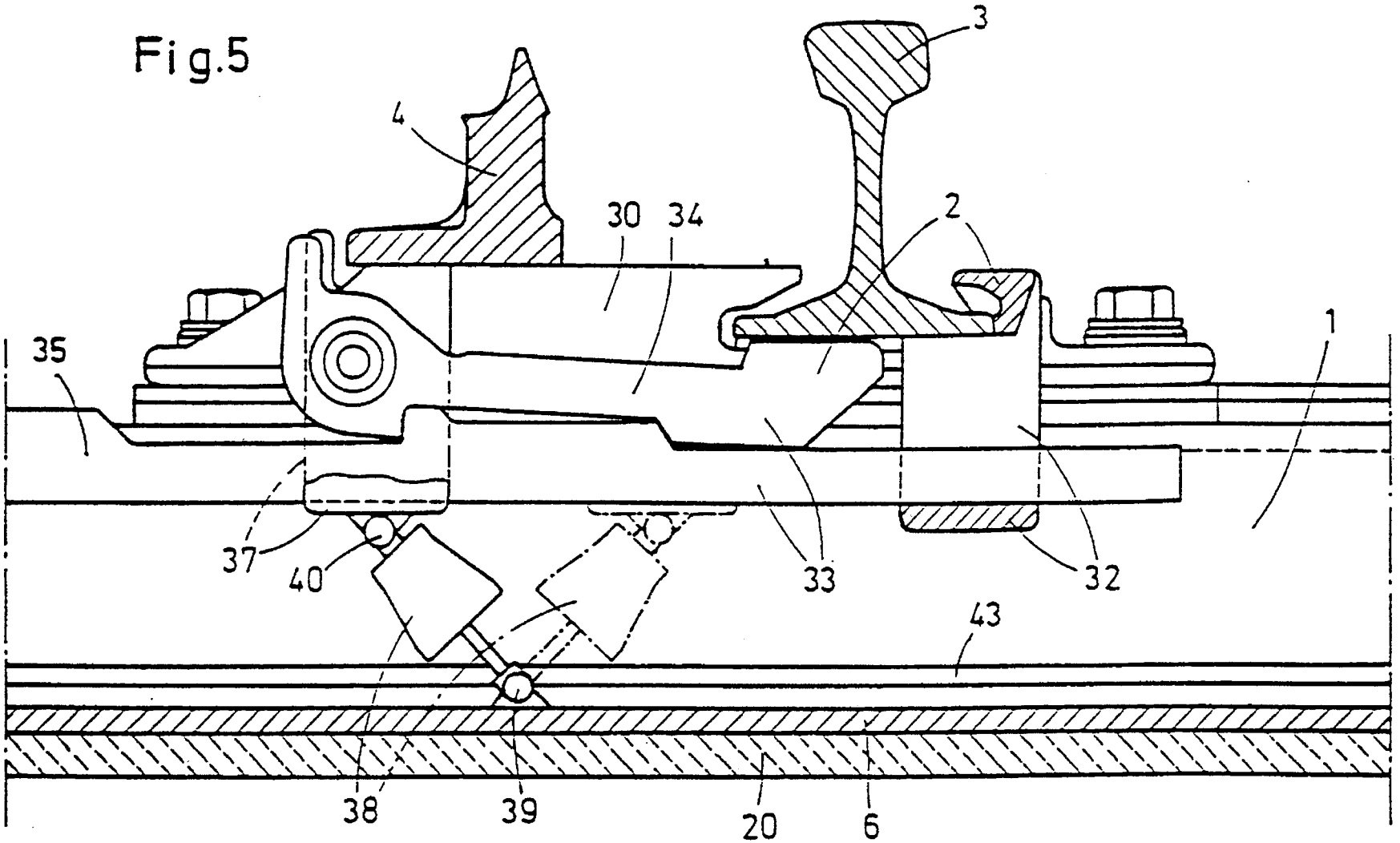
FIG. 5 is a larger-scale view of the part marked V in FIG. 1*b;*
Figure 6:
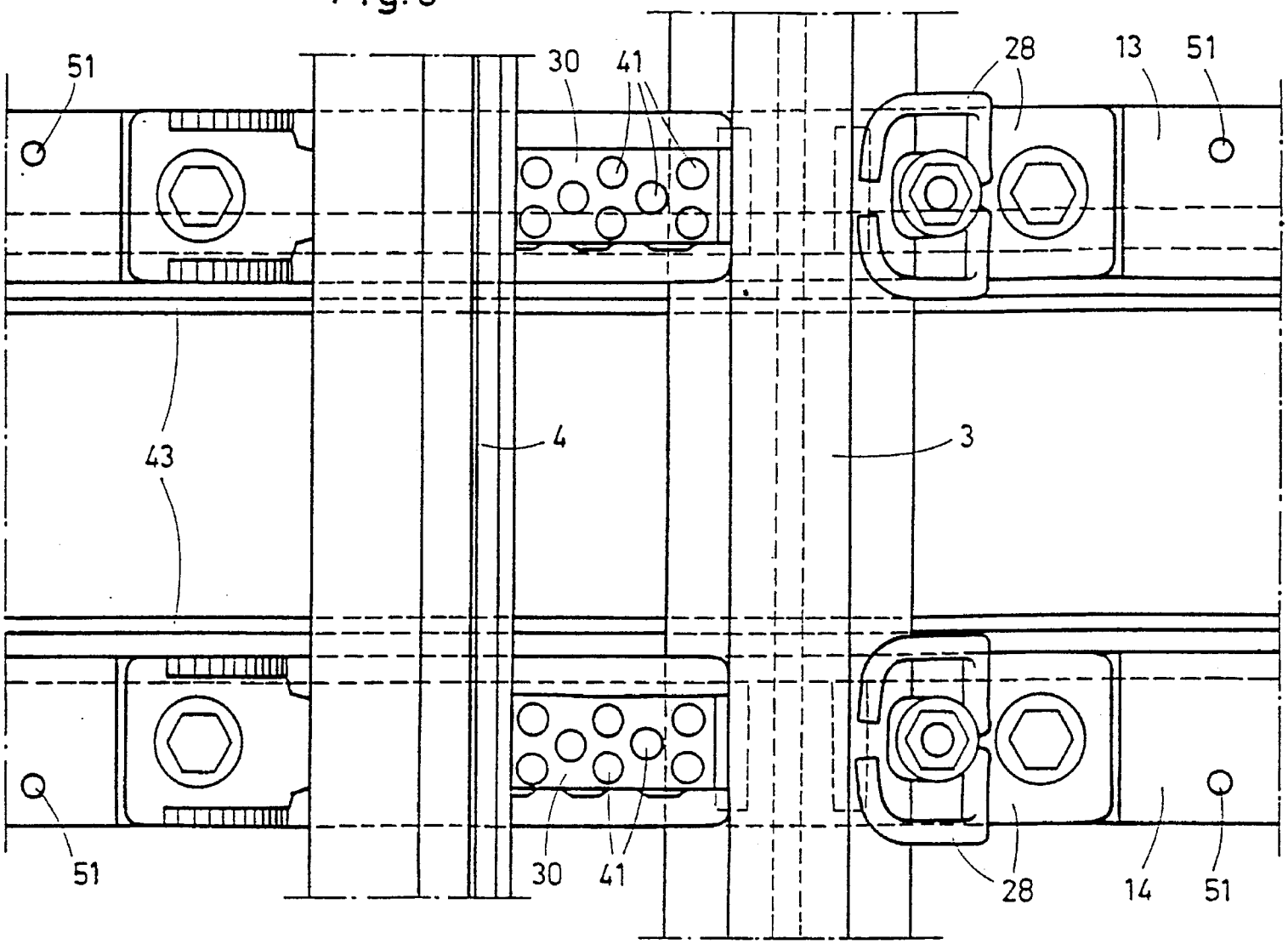
FIG. 6 is a larger-scale view of the part marked VI in FIG. 2*b;*

If a box sleeper 1 is laid together with concrete sleepers, according to an important additional feature the trough or box-like sleeper section member 5 is provided with a preferably concrete outer coating 20 along the portion underneath the bearing flanges 13, i.e. along the bottom or web 6 and the two arms 7 and 8, so that the friction here is the same as for normal concrete sleepers. Since the outer coating 20 is relatively thin, i.e. between about 20 mm and about 25 mm, it is recommended to use a special concrete or fibre, more particularly glass fibre concrete, and to anchor it to the trough or box-like sleeper section member 5 by suitable additional steps. The anchoring of the outer coating 20 to the trough or box-like sleeper section member 5 must withstand all stresses during traffic over the box sleeper resting on the gravel bed. According to the invention, therefore, the outer coating 20, over the entire length of the box sleeper 1, rests on steel edge-protecting members 21, which are permanently connected to the trough or box-like sleeper section member 5 at least by struts 22, preferably by welding. At least along parts of the length of the box sleeper, edge-protecting members 21 can be directly welded via one of their flanges to the trough or box-like sleeper section member 5, as shown in FIGS. 4 and 8.

Figure 7:
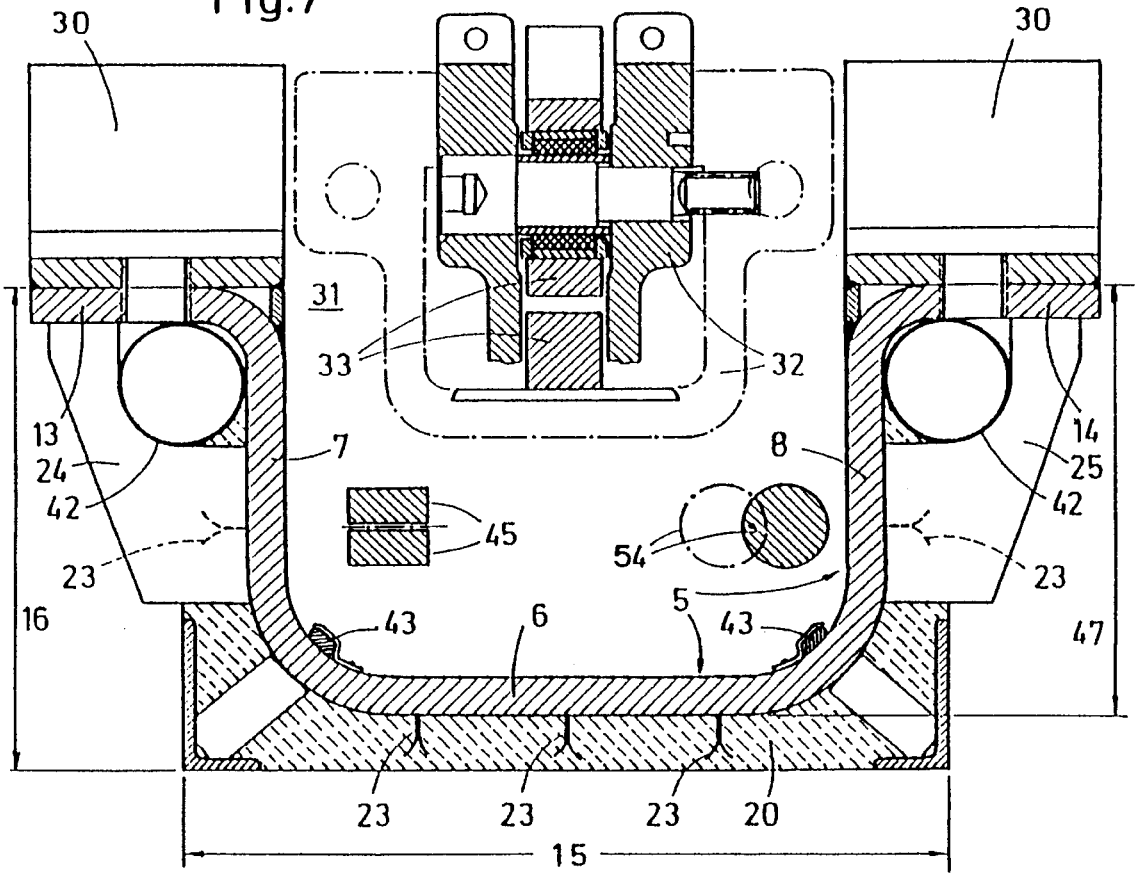
FIG. 7 is a larger-scale view of the cross-section corresponding to FIG. 3.
Figure 8:
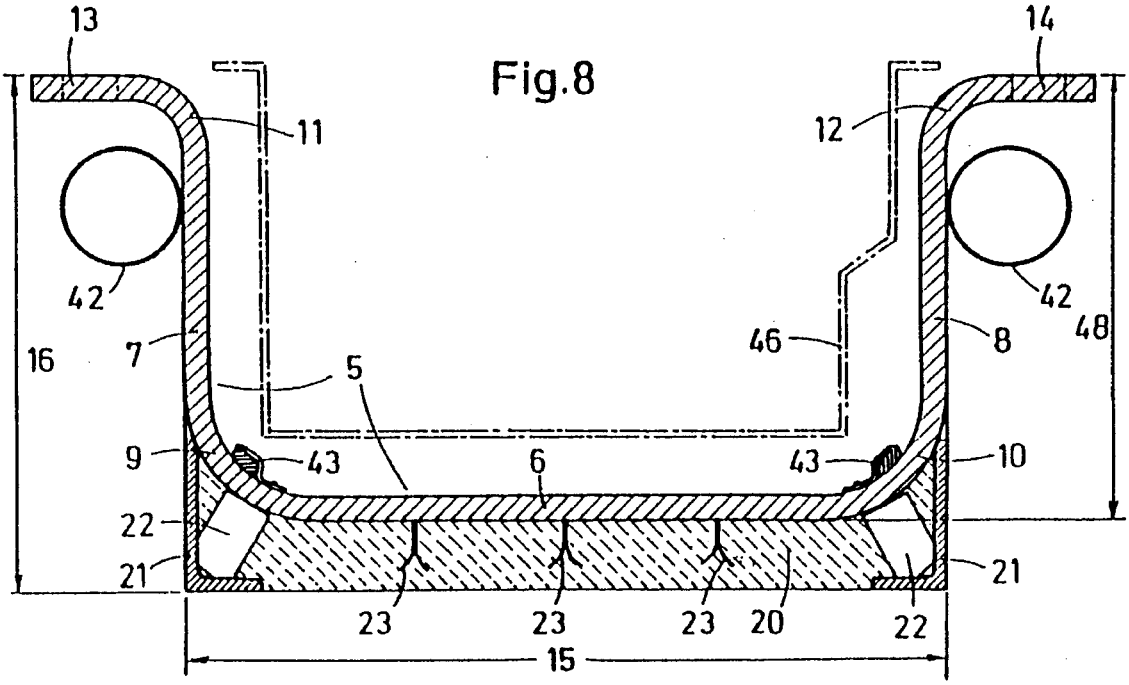
FIG. 8 is a larger-scale view of the cross-section corresponding to FIG. 4.

At the flat bottom regions 6 and the arms 7 and 8 of the trough or box-like sleeper section member 5, the outer coating can also be anchored by welded expanding bolts or slotted pins 23, as shown diagrammatically in FIGS. 7 and 8.

Figure 3:
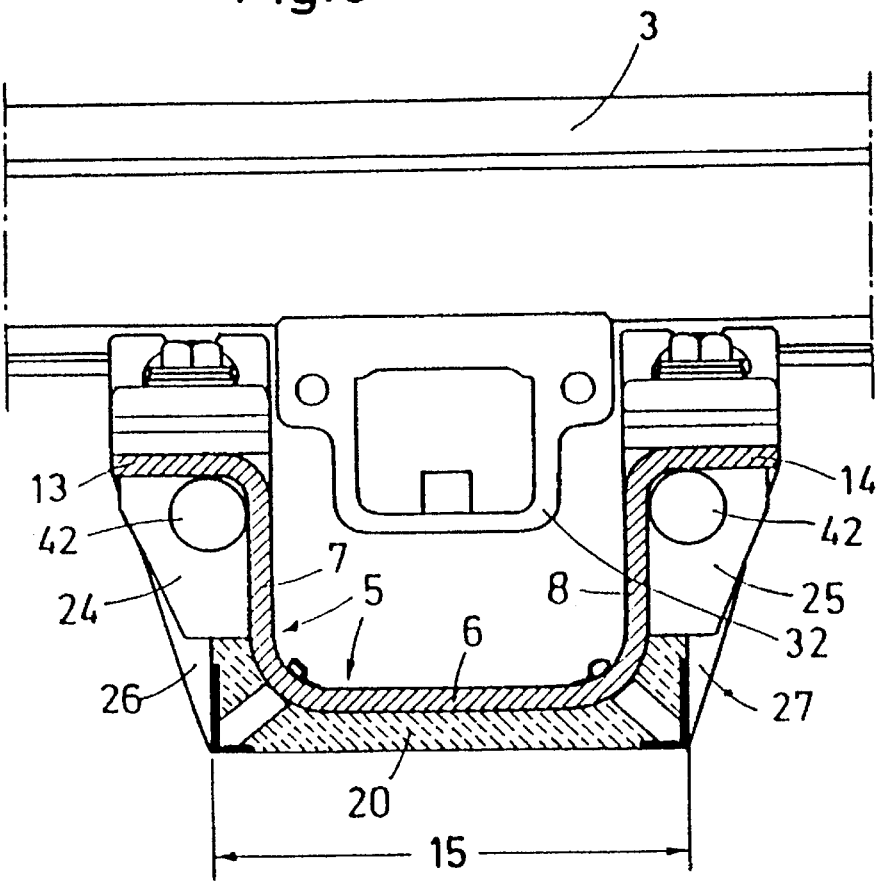
FIG. 3 is a section along line III—III in FIG. 1*a;*

As shown in FIGS. 3 and 7, the bearing flanges 13 and 14 of the trough or box-like sleeper section member 5 are braced by strips 24 and 25 against the arms 7 and 8, which form the side walls of the trough or box-like sleeper section member 5. It is important to provide the strips 24, 25 at least in the longitudinal region of the trough or box-like sleeper section member 5, where loads and forces from railway traffic are received via the stock rails 3 of the respective points. Advantageously therefore the trough or box-like sleeper section member 5 is provided with strips 24 and 25 at least at the places where the stock-rail securing means 28 and 29 and the slide chairs for the travelled-over points tongues 4 rest on the bearing flanges of the trough or box-like sleeper section member.

Close to the stock-rail fastenings 28, 29 and the slide chairs 30, the stationary holder 32 of a tip fastener for the points tongues 4 extends into the trough or box-like sleeper section member 5, at least into its upwardly open region 31. The fastener can be a latch fastener 33, e.g. type CKA 9.

The arrangement, construction and operation of the latch fastenings 33 is shown in FIGS. 1*a* and 1*b*, whereas the position in which they are installed relative to the cross-section of the box sleeper 1 is shown particularly in FIGS. 3 and 7.

FIG. 1*a* shows the operative position of the latch fastening 33 when retracted and when the points tongue 4 abuts the stock rail 3, whereas FIG. 1*b* shows the operation of the latch fastener 33 when extended and when the points tongue 4 is removed from the stock rail 3.

The latch 34 and the associated cam rod 35 are important parts of each latch fastening 33. The latch 34 is suspended from a cam-rod bearing 37 so as to be pivotable around a horizontal axis 36, the bearing being connected to and moving with the points tongue 4, whereas the cam rod 35 moves on the one hand in the bearing 37 and on the other hand in the stationary holder bearing 32. The operation of the latch fastening 33 will be clear from a comparison of FIG. 1*a* with FIG. 1*b*, but is not a part of the invention. The only important point is that the latch fastening 33 has a shape which can without difficulty be put through the opening 31 into the clear space in the trough or box-like sleeper section member 5, as shown in FIGS. 3 and 7.

The box sleeper 1 has a special feature in that an e.g. elastomer-based shock-absorbing element 38 is provided therein near each latch fastening 33 and is pivotably held at one end in a stationary bearing 39 at the bottom of the trough or box-like sleeper section member 5, which at the other end pivotably engages a bearing 40 on the movable cam-rod bearing 37.

The shock-absorbing elements 38 are adapted to pull the respective points tongue 4, both in the adjacent position (FIG. 1*a*) and in the remote position (FIG. 1*b*), vertically with a force between about 200 and 300 Kp towards the sliding surfaces, particularly towards sliding inserts 41 on the slide chairs, thus substantially damping any vibration. The shock-absorbing elements are under compressive stress and have a vertical shock-absorbing travel between 3 and 4 mm, which ensures a strong damping effect and a long service life.

As shown in FIGS. 3, 4 and 7 and 8, a cable duct 42 is secured and extends along the outside of the trough or box-like sleeper section member 5 under each of its bearing flanges 13 and 14 and prevents damage to cables or other power lines running transversely to the track.

As shown in FIGS. 1 to 8, heating rods 43 can be laid substantially lengthwise inside the trough or box-like sleeper section member 5 of the box sleeper 1, the terminal boxes 44 of the heating rods being on or near the removable transverse plate 17. The heating rods can advantageously be placed in the bottom region on small platforms, so that they are not in a damp place.

The drive rods 54 and the monitoring means 45 for the points tongues 4 are also accommodated in the trough or box-like sleeper section member 5 of the box sleeper 1, as shown in FIG. 7.

As shown in FIG. 8, the points drive, disposed in a basin 46, can also be completely accommodated in the clear space in the trough or box-like sleeper section member 5 of the box sleeper 1.

As shown particularly by comparison between FIGS. 7 and 8, the (longer) longitudinal part of the trough or box-like sleeper section member 5 corresponding to section III—III in FIG. 1*a* is made of thicker sheet steel than the (shorter) longitudinal part corresponding to section IV—IV in FIG. 1*a*, and also its cross-sectional height 47 is greater than the height 48 in FIG. 8.

The cross-sectional shape corresponding to section IV—IV in FIG. 4 and 8 is obtained by means of a prolongation 49 on one side of the trough or box-like sleeper section member and permanently connected to the remaining longitudinal part 50 thereof.

The two angles 26 and 27 in FIG. 3 show the outermost angular position, about 18°, of the tamping picks of the fully automatic track-tamping machines.

Another important feature of the box sleeper 1 is that its open region 31 can be substantially closed by releasably attached covers. Accordingly the supporting flanges 13, 14 of the pressure section member are formed with longitudinally spaced holes 51 in which the covers can be secured.

The covers have openings only at the place where the moving parts of the latch fastenings 33 are disposed, or where they have to extend upwards or downwards through the open region 31 of the box rail 1. These openings, however, are covered over the respective movement area by resilient plastics or similar bellows, to keep weather, rain, snow and excess pollution away from the interior of the box sleeper, which is otherwise closed by the covers.

Slots for a water outlet can be provided at least in the transverse plate 18 and also in the head wall 17 of the box sleeper 1.

For simplicity, the covers over the top of the box sleeper 1 are not shown in the drawings. They can however be formed by sufficiently sturdy, substantially flat metal plates, which are repeatedly divided lengthwise of the box sleeper 1 and have cut-outs for admitting moving parts of the latch fastenings 33. The cut-outs, however, can be substantially covered against weather and dirt by resilient plastics bellows. As a rule, the covers need to be removed only for maintenance or repairs of the points drive or associated latch fastenings or shock-absorbing elements thereof, or for replacing the heating rods.

An important feature of the box sleeper 1 is that underneath its supporting flanges its overall width corresponds to that of normal wooden or concrete sleepers. A box sleeper of this kind, without hindrance by the laterally projecting. supporting flanges 13 and 14 of the trough or box-like sleeper section member 5, can be mechanically tamped from both sides without difficulty, provided care is taken that the strips 24 and 25, provided at places for bracing the flanges 13 and 14 against the arms 7 and 8 of the trough or box-like sleeper section member 5, have an upwardly tapering shape and their outwardly directed boundary edges do not project beyond a line which at one end touches the longitudinal edge of the supporting flanges and at the other end touches the lower longitudinal edge of the box sleeper, the inclination relative to the vertical being not more than 18°. If this is so, the rams of the track tamping machine can tamp the gravel bed in optimum manner without hindrance in the immediate neighbourhood of both sides of the box sleeper 1.

We claim:

1. A sleeper for railway track systems, comprising a steel box-like sleeper section member (5) having an upper open part (31) and a bottom closed part, which said member has a cross-sectional width (15) and a cross-sectional height (16) matching that of a concrete or wooden sleeper and which has laterally projecting bearing flanges (13 and 14) for mounting points-tongue slide chairs (30) and/or associated operating components of tip fasteners, an upper portion of the box-like sleeper section member (5) supporting said tip fasteners in the form of latch fasteners (33), comprising holders (32), movable latches (34), cam rods (35) and cam-rod guides, fitted into the upper or open part (31) of the box-like sleeper section member (5), whereas the bottom part houses points-tongue slide rods (54), tongue-monitoring linkage (45), a basin (46) for points drive, heating rods (43) and shock-absorbing elements (38).

2. The sleeper according to claim 1, including transverse plates and releasably mounted covers wherein the open part (31) of the box-like sleeper section member (5) is closable on top by said releasably mounted covers which are securable to the bearing flanges (13 and 14), the box-like sleeper section member (5) and the transverse plates (17, 18) forming a closed box.

3. The sleeper according to claim 1, including a prolongation (49) on one side of the box-like sleeper section member (5) holding said basin (46) for said points-tongue slide rods (54).

4. The sleeper according to claim 1, including movable bearings (27) for said latch fasteners (33) and said elastomeric shock-absorbing element (38) engagable to each movable bearing (37) of said latch fasteners (33) and pivotally mounted on a surface of the box-like sleeper section member (5) to be pivoted between two end positions (39).

5. The sleeper according to, claim 1, wherein the box-like sleeper section member (5) has sides under the bearing flanges (13 and 14), said bottom part and sides having an outer coating of concrete (20) and forming a structural unit therewith constituting a box.

6. The sleeper according to claim 3, wherein said prolongation (49) of the box-like sleeper section member has a bottom and has disposed thereon a coating (20) of concrete at least under the bottom (6).

7. The sleeper according to claim 5, including steel edge-protection angle members and expanding bolts or slotted pins wherein the outer coating (20) has said steel edge-protecting angle members (21) braced against the box-like sleeper section member (5), and the box-like sleeper section member (5) and prolongation (49) have said expanding bolts or slotted pins (23) extending therefrom to anchor said concrete coating.

8. The sleeper according to claim 1, including bracing strips extending from the sides and flanges of the box-like sleeper section member (5), said bracing strips having holes therein to support cable ducts (42) extending lengthwise of the box-like sleeper section member (5).

9. The sleeper according to claim 8, wherein the bracing strips are positioned in an area of the sleeper where rails are supported.

10. The sleeper according to claim 1, wherein at least one transverse plate defines a water outlet opening (52).

11. The sleeper according to claim 2, including plastic bellows, wherein the covers for the box-like sleeper section member (5) have recesses, covered by said plastic bellows.

12. The sleeper according to claim 5, including heating rods (43) and a terminal box (44) disposed in said box-like sleeper section member (5) of said box so that the heating rods may be replaceable via their terminal box (44) and a transverse plate (17).

13. The sleeper according to claim 2, including a prolongation (49) on one side of said box-like sleeper section member (5) holding said basin (46) for said points-tongue slide rods (54).

14. The sleeper according to claim 2, including movable bearings (37) for said latch fasteners (33) and said elastomeric shock-absorbing element (38) engagable to each movable bearing (37) of said latch fasteners (33) and pivotally mounted on a surface of the box-like sleeper section member (5) to be pivoted between two end positions (39).

15. The sleeper according to claim 3, including movable bearings (37) for said latch fasteners (33) and said elastomeric shock-absorbing element (38) engagable to each movable bearing (37) of said latch fasteners (33) and pivotally mounted on a surface of the box-like sleeper section member (5) to be pivoted between two end positions (39).

16. The sleeper according to claim 13, including movable bearings (37) for said latch fasteners (33) and said elastomeric shock-absorbing element (38) engagable to each movable bearing (37) of said latch fasteners (33) and pivotally mounted on a surface of the box-like sleeper section member (5) to be pivoted between two end positions (39).

17. The sleeper according to claim 2, wherein said box-like sleeper section member (5) has sides under the bearing flanges (13 and 14), said bottom part and sides having an outer coating of concrete (20).

18. The sleeper according to claim 3, wherein said box-like sleeper section member (5) has sides under the bearing flanges (13 and 14), said bottom part and sides having an outer coating of concrete (20).

19. The sleeper according to claim 13, wherein said box-like sleeper section member (5) has sides under the bearing flanges (13 and 14), said bottom part and sides having an outer coating of concrete (20).

20. The sleeper according to claim 4, wherein said box-like sleeper section member (5) has sides under the bearing flanges (13 and 14), said bottom part and sides having an outer coating of concrete (20).

* * * * *

US005562267C1

(12) REEXAMINATION CERTIFICATE (4604th)

United States Patent

Heim et al.

(10) Number: US 5,562,267 C1

(45) Certificate Issued: Jun. 25, 2002

(54) CROSS-TIES FOR RAILROAD TRACK SYSTEMS

(75) Inventors: Armin Heim, Kreuzlingen (CH); K. Ohm, Schwabach (DE); K. Spiegel, Hassfurt (DE); Rudolf Köpl, Munich (DE); Jurgen Kruger, Wunstorf (DE); Volker Klein, Hamburg (DE); Hans-Joachim Scholte, Iserlohn (DE)

(73) Assignees: Schwihag GmbH, Tagerwilen (CH); Deutsche Bahn AG, Minden (DE)

Reexamination Request:
No. 90/005,989, Apr. 25, 2001

Reexamination Certificate for:

| | |
|---|---|
| Patent No.: | **5,562,267** |
| Issued: | **Oct. 8, 1996** |
| Appl. No.: | **08/237,365** |
| Filed: | **May 5, 1994** |

(30) Foreign Application Priority Data

May 7, 1993 (DE) ..... 43 15 200

(51) Int. Cl.[7] ..... E01B 7/00

(52) U.S. Cl. ..... 246/415 R; 246/449; 246/453; 238/29

(56) References Cited

U.S. PATENT DOCUMENTS

| | | | | |
|---|---|---|---|---|
| 773,666 A | | 11/1904 | McCall | |
| 1,802,875 A | * | 4/1931 | Conley | 246/257 |
| 2,704,517 A | | 3/1955 | de Garcia | |
| 4,093,163 A | | 6/1978 | Larsson | |
| 5,562,267 A | | 10/1996 | Helm et al. | |

FOREIGN PATENT DOCUMENTS

DE 3838415 C2 8/1991

OTHER PUBLICATIONS

Integra Signum I, House Journal of Integra Signum AG, Switzerland, Edition Apr. 1992, Dec. 1992, pp. 13–16.

Integra Signum II, Information brochure to pawl point CKA 6, Feb. 1988.

"Die Grundsätze der Sicherungsanlagen für den Eisenbahnbetrieb", R. Hämmerli, Vol. 1, Jun. 1982, SBB.

* cited by examiner

*Primary Examiner*—Mark T. Le

(57) ABSTRACT

A box sleeper (1), characterized by a steel box-life sleeper section member (5) which has a cross-sectional width (15) and a cross-sectional height (16) matching that of a normal concrete or wooden sleeper and has an open part (31) on top and is closable at its ends by transverse plates (17 and 18) and has laterally projecting bearing flanges (13 and 14) for stockrail fasteners (28, 29), points-tongue slide chairs (30) and/or operating components of tip fasteners. The box-like sleeper section member (5) is associated with tip fasteners in the form of "latch fasteners" (33) comprising stationary guides (32) and movable latches (34), cam rods (34) and cam-rod bearings (37), all of which project into the upper part (31) of the box-like sleeper section member (5), whereas the bottom part houses the points-tongue slide rods (54), the tongue-monitoring linkage (45), heating rods (43) if any, and shock-absorbing elements (38). The open part (31) of the box-like sleeper section member (5) is closable on top by releasably mounted covers which can be secured to the bearing flanges (13 and 14) of the box-like sleeper section member (5) of the box sleeper (1).

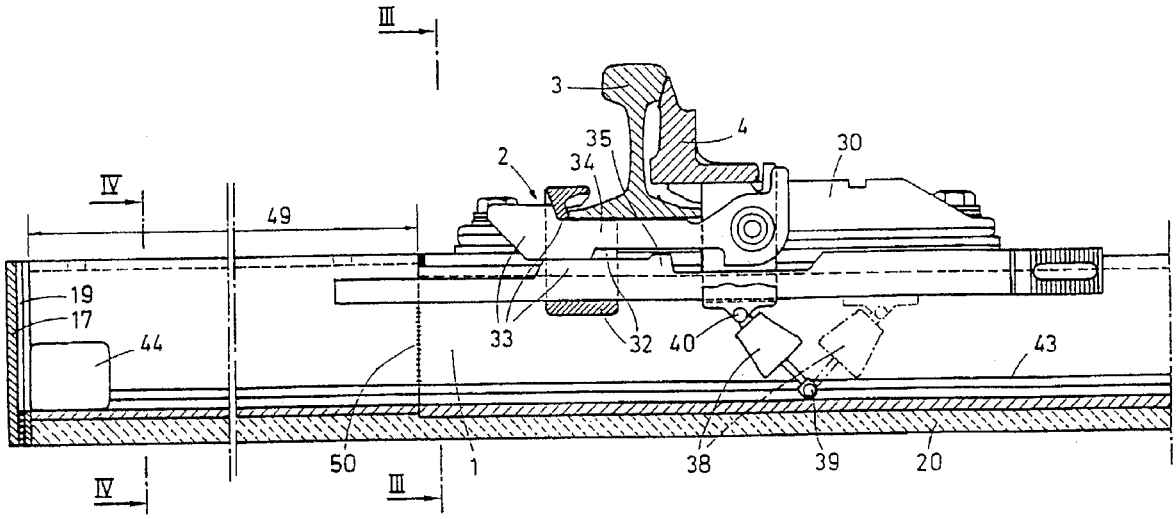

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–20 is confirmed.

* * * * *